United States Patent [19]

Cosco et al.

[11] 4,130,774

[45] Dec. 19, 1978

[54] FLASH TUBE HAVING IMPROVED END CAP CONSTRUCTION

[75] Inventors: Robert J. Cosco, Amesbury; Charles C. Kokinos, Jr.; Charles J. Geleski, both of Lynn, all of Mass.

[73] Assignee: GTE Sylvania Incorporated, Danvers, Mass.

[21] Appl. No.: 851,158

[22] Filed: Nov. 14, 1977

[51] Int. Cl.[2] ..... H01J 5/46

[52] U.S. Cl. ..... 313/318; 313/331

[58] Field of Search ..... 313/318, 332, 333, 219, 313/334, 335, 356

[56] References Cited

U.S. PATENT DOCUMENTS

| | | | |
|---|---|---|---|
| 3,742,283 | 6/1973 | Loughridge | 313/318 |
| 3,855,495 | 12/1974 | Pappas et al. | 313/331 X |
| 3,885,186 | 5/1975 | Vause | 313/318 |

*Primary Examiner*—Eugene R. LaRoche

*Attorney, Agent, or Firm*—James Theodosopoulos

[57] ABSTRACT

A flash tube has a lead-in wire extending through the end of the flash tube. An end cap is bonded to the end of the flash tube with bonding material. A flexible sleeve is disposed around the lead-in wire to prevent contact between the bonding material and the lead-in wire.

2 Claims, 1 Drawing Figure

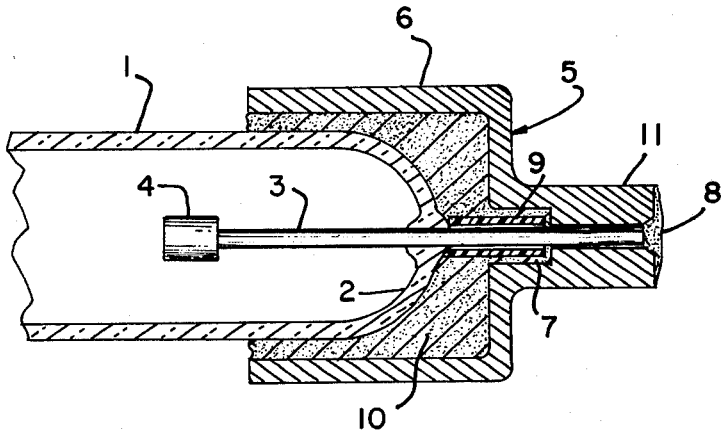
6
1
5
11
9
4
3
8
2
7
10

FLASH TUBE HAVING IMPROVED END CAP CONSTRUCTION

THE INVENTION

This invention is concerned with flash tubes such as are shown, for example, in U.S. Pat. No. 3,855,495, the disclosure of which is incorporated herein by reference. It is particularly concerned with the lead-in wire sealed at the end of the flash tube. When a braided lead-in wire is soldered to the metal terminal portion of an end cap, a solder buildup at the seal region can reduce the flexibility of the lead-in wire. When the end cap is then bonded to the flash tube, the hard bonding material around the lead-in wire can further rigidify the lead-in wire. Thus when the terminal portion of the end cap is pressed into the usual electrical pressure contacts, it is possible for strains to be transmitted to the glass seal where the lead-in wire is embedded, and to crack the glass seal. It is the purpose of this invention to eliminate or minimize such cracking.

In this invention a plastic sleeve is placed around the lead-in wire at the seal region. The sleeve acts as a cushion between the hard bonding material and the lead-in wire. It can also prevent solder buildup at the seal region.

The drawing is a sectional view of an end cap region of a flash tube.

As shown in the drawing, a flashtube 1 is sealed at its end 2 around a lead-in wire 3 having an electrode 4 on its inner end. Disposed around end 2 of flash tube 1 is an end cap 5 having a shoulder portion 6, a terminal portion 11 and a cavity 7 extending therebetween. Lead-in wire 3 extends through a hole in end cap 5 and is soldered to terminal portion 11 at tip 8. A flexible plastic or rubber sleeve 9 surrounding lead-in wire 3 extends from end 2 into cavity 7. Thus, when bonding material 10 is introduced into the space betweeen shoulder portion 6 and flash tube 1 in order to bond them together, sleeve 9 shields lead-in wire 3 from bonding material 10. Because of the cushioning action of plastic sleeve 9, the sleeve prevents transmission of stress forces from bonding material 10 to lead-in wire 3.

In a specific example, the diameter of glass flash tube 1 was 25/64 inch. Lead-in wire 3 consisted of 40 mil tungsten wire butt welded to a 40 mil nickel braided wire, the tungsten wire extending from electrode 4 to just outside the seal, the nickel wire extending therefrom to tip 8. End cap 5 was made of metal and had a terminal diameter of 0.280 inch. The inside and outside diameters of shoulder portion 6 were 7/16 inch and ½ inch respectively. Plastic sleeve 9 was made of teflon and was 60 mils inside diameter by 90 mils outside diameter by about 200 mils long. Bonding material 10 was a hard setting ceramic type of cement. The overall length of end cap 5 was ⅞ inch and the length of shoulder portion 6 and 5/16 inch.

We claim:

1. A flash tube comprising: an elongated glass envelope sealed at its end; an end cap having a shoulder portion and a terminal portion, the shoulder portion encircling the end of the envelope and being bonded thereto with bonding material; a lead-in wire extending through the end of the envelope and being connected to the terminal portion of the end cap; and a cushioning sleeve disposed on the lead-in wire and preventing contact of the bonding material with the lead-in wire.

2. The flash tube of claim 1 wherein the end cap has a cavity extending from the shoulder portion to the terminal portion and where the cushioning sleeve extends from the end of the envelope into the cavity.

* * * * *